US008587918B2

(12) United States Patent
Hanchett et al.

(10) Patent No.: US 8,587,918 B2
(45) Date of Patent: Nov. 19, 2013

(54) SYSTEMS AND METHODS FOR ELECTRODES FOR INSULATIVE ELECTRONIC WEAPONRY

(75) Inventors: Mark A. Hanchett, Phoenix, AZ (US); Mark Joseph Phelps, New Brighton, MN (US); Patrick W. Smith, Scottsdale, AZ (US); Steven N. D. Brundula, Chandler, AZ (US); Douglas J. Landers, Phoenix, AZ (US); Andrew F. Hinz, Mesa, AZ (US)

(73) Assignee: TASER International, Inc., Scottsdale, AZ (US)

( * ) Notice: Subject to any disclaimer, the term of this patent is extended or adjusted under 35 U.S.C. 154(b) by 229 days.

(21) Appl. No.: 12/842,866

(22) Filed: Jul. 23, 2010

(65) Prior Publication Data

US 2012/0019975 A1 Jan. 26, 2012

(51) Int. Cl.
*H05C 1/04* (2006.01)
*F41C 9/00* (2006.01)

(52) U.S. Cl.
USPC ..... 361/232

(58) Field of Classification Search
USPC ..... 361/232
See application file for complete search history.

(56) References Cited

U.S. PATENT DOCUMENTS 3,457,921 A * 7/1969 Waldeisen ..... 604/130
3,771,249 A * 11/1973 Johnson et al. ..... 43/6
3,826,245 A 7/1974 Funfstuck
3,976,055 A 8/1976 Monter
4,031,591 A 6/1977 Collins
4,253,132 A 2/1981 Cover
4,610,808 A 9/1986 Kleiner
4,867,166 A 9/1989 Axelgaard
5,269,810 A 12/1993 Hull
5,427,096 A 6/1995 Bogusiewicz
5,654,867 A * 8/1997 Murray ..... 361/232
5,737,501 A * 4/1998 Tsunekawa ..... 358/1.2
5,831,199 A * 11/1998 McNulty et al. ..... 89/1.11
5,962,806 A 10/1999 Coakley
6,505,082 B1 1/2003 Scheiner et al.
6,636,412 B2 * 10/2003 Smith ..... 361/232
6,733,496 B2 5/2004 Sharkey et al.
6,898,887 B1 * 5/2005 Stratbucker ..... 42/1.08
7,100,514 B2 9/2006 LeBourgeois
7,111,559 B1 * 9/2006 MacLachlan ..... 102/502

(Continued)

FOREIGN PATENT DOCUMENTS

GB 2384042 7/2003

*Primary Examiner* — Rexford Barnie
*Assistant Examiner* — Angela Brooks
(74) *Attorney, Agent, or Firm* — William R. Bachand

(57) ABSTRACT

An electronic weapon with an installed deployment unit, from which at least one tethered electrode is launched, provides a stimulus current through a target to inhibit locomotion by the target. The wire tether, also called a filament, conducts the stimulus current. The one or more electrodes, according to various aspects of the present invention, perform one or more of the following functions in any combination: binding the filament to the electrode, deploying the filament from the deployment unit, coupling the electrode to the target, and distributing a current density with respect to a region of target tissue and/or a volume of target tissue. For an electrode that includes a body and a spear, the spear may be implemented with conductive rings or with materials that include integrated conductive and insulative substances (e.g., conductive fibers in insulative composite material). Relatively high electric field flux density at a tip of the spear may be reduced or avoided by practice of the invention.

17 Claims, 6 Drawing Sheets

(56) References Cited

U.S. PATENT DOCUMENTS

| | | | | |
|---|---|---|---|---|
| 7,314,007 | B2 * | 1/2008 | Su | 102/502 |
| 7,602,597 | B2 * | 10/2009 | Smith et al. | 361/232 |
| 8,074,573 | B1 * | 12/2011 | Linker | 102/502 |
| 2003/0094113 | A1 * | 5/2003 | Warnagiris et al. | 102/502 |
| 2005/0033397 | A1 | 2/2005 | Aisenbrey | |
| 2006/0086032 | A1 | 4/2006 | Valencic | |
| 2008/0007887 | A1 | 1/2008 | Weaver | |
| 2009/0076502 | A1 | 3/2009 | Azure | |
| 2010/0089273 | A1 | 4/2010 | Kroll | |
| 2010/0315755 | A1 | 12/2010 | Gavin | |
| 2010/0315756 | A1 | 12/2010 | Gavin | |
| 2011/0176250 | A1 | 7/2011 | Hinz | |
| 2013/0021716 | A1 * | 1/2013 | Kotos | 361/232 |

* cited by examiner

SYSTEMS AND METHODS FOR ELECTRODES FOR INSULATIVE ELECTRONIC WEAPONRY

FIELD OF THE INVENTION

Embodiments of the present invention relate to electronic weaponry, deployment units, and electrodes used in deployment units for electronic weaponry, and to methods of providing a current through a human or animal target via at least one electrode having a current spreading capability.

BACKGROUND OF THE INVENTION

Conventional electronic weapons launch one or more electrodes toward a human or animal target to deliver a stimulus signal through the target to inhibit locomotion by the target. A thin conductor called a filament (e.g., wire) couples a signal generator in the electronic weapon to a launched electrode positioned in or near the target. The signal generator provides the stimulus signal through the target via the filament, the electrode, and a return path to complete a closed circuit. The return path may be through earth and/or through a second filament and electrode. Conventional electrodes are made of conductive materials and have a sharp barbed tip to acquire and remain in a position in or near a target (e.g., lodge in clothing, skin). Consequently, relatively high field strengths and current densities occur at the electrode tip. Generally, reducing current at the tip of an electrode and increasing current at the skin of the target is desired.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
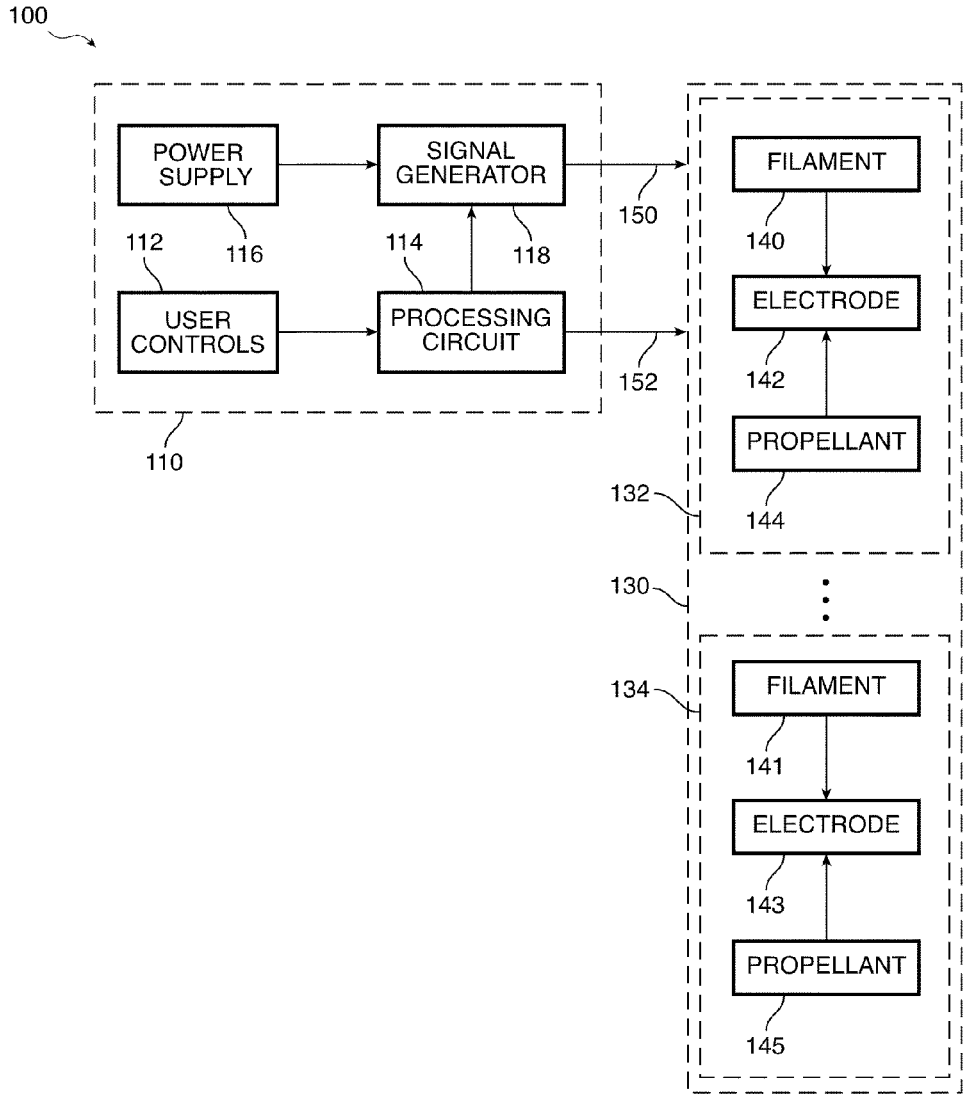
FIG. 1 is a functional block diagram of an electronic weapon according to various aspects of the present invention.

An electronic weapon, according to various aspects of the present invention, delivers a current through a human or animal target to interfere with locomotion by the target. An important class of electronic weapons launch at least one tethered electrode, also called a dart or a probe, toward a target to position the electrode in or near target tissue. A respective filament (e.g., wire with or without insulation) extends from the electronic weapon to each electrode at the target, thereby tethering the electrode to the electronic weapon. One or more electrodes may form a circuit through a target. The circuit conducts the stimulus signal. The circuit's return path may be through ground, through one or more additional tethered electrodes, or through a conductive path (e.g., liquid, plasma) formed by the electronic weapon to the target. The electronic weapon provides a stimulus signal (e.g., current, pulses of current) through, inter alia, the filament, the electrode, and the target to interfere with locomotion by the target. Interference includes causing involuntary contraction of skeletal muscles to halt voluntary locomotion by the target and/or causing pain to the target to motivate the target to voluntarily stop moving.

Conventional stimulus signals may be used. For example, a stimulus signal may comprise about 19 current pulses per second at a duty cycle less than 1/400, repeated for a period of from 5 to 30 seconds to facilitate arrest of the target or escape from the target.

An electronic weapon, according to various aspects of the present invention, may include a launch device and one or more field replaceable deployment units mounted to the electronic weapon. Each deployment unit may include expendable (e.g., single use) components (e.g., tether wires, electrodes, propellant), and storage cavities (e.g., bores, chambers). Herein, a filament is interchangeably called a wire, a tether wire, and a tether. A tethered electrode is an assembly of a filament and an electrode at least mechanically coupled to an end portion of the filament. A portion of the filament near the other end of the filament is at least mechanically coupled to the deployment unit and/or the launch device (e.g., one end fixed within the deployment unit), generally until the deployment unit is removed from the electronic weapon. As discussed below, mechanical coupling may facilitate electrical coupling of the launch device and the target prior to and/or during operation of the electronic weapon.

A launch device of an electronic weapon launches at least one tethered electrode of the electronic weapon toward a target. As the electrode travels toward the target, the electrode deploys (e.g., pulls) a length of filament from storage within the deployment unit. The filament trails the electrode. After launch, the filament spans (e.g., extends, bridges, stretches) a distance from the deployment unit to the electrode generally positioned in or near a target.

Electronic weapons that use tethered electrodes, according to various aspects of the present invention, include handheld devices, apparatus fixed to buildings or vehicles, and stand-alone stations. Hand-held devices may be used in law enforcement, for example, deployed by an officer to take custody of a target. Apparatus fixed to buildings or vehicles may be used at security checkpoints or borders, for example, to manually or automatically acquire, track, and/or deploy electrodes to stop intruders. Stand-alone stations may be set up for area denial, for example, as used by military operations. Conventional electronic weapons such as the model X26 electronic control device and Shockwave™ area denial unit, each marketed by TASER International, Inc., may be modified to implement the teachings of the present invention by replacing the conventional deployment units with deployment units having electrodes as discussed herein.

An electrode, according to various aspects of the present invention, provides a mass for launching toward a target. The intrinsic mass of an electrode includes a mass that is sufficient to fly, under force of a propellant, from a launch device to a target. The mass of the electrode includes a mass that is sufficient to deploy (e.g., pull, uncoil, unravel, draw) a filament from storage. The mass of the electrode is sufficient to deploy a filament behind the electrode while the electrode flies toward a target. The mass of the electrode deploys the filament from storage and behind the electrode in such a manner that the filament spans a distance between the launch device and the electrode positioned at a target. The mass of an electrode is generally insufficient to cause serious blunt impact trauma to a target. In one implementation, the mass of an electrode is in the range of 2.0 to 3.0 grams, preferably about 2.8 grams.

An electrode provides a surface area for receiving a propelling force to propel the electrode away from a launch device and toward a target. Movement of the electrode away from the launch device is limited by aerodynamic drag and resistance force (e.g., tension in the filament) that resists deploying a filament from storage and pulling the filament behind the electrode in flight toward a target.

A forward portion of an electrode may be oriented toward a target prior to launch. Upon launch and/or during flight from the launch device toward the target, the forward portion of the electrode orients toward the target. An electrode has an aerodynamic form for maintaining the forward portion of the electrode oriented toward a target. The aerodynamic form of an electrode provides suitable accuracy for hitting the target.

An electrode includes a shape for receiving a propelling force to propel the electrode toward a target. A shape of an electrode may correspond to a shape of a portion of the launch device or deployment unit that provides a propelling force to propel the electrode. For example, a cylindrical electrode may be propelled from a cylindrical tube of a deployment unit. During a launch of an electrode by expanding gas, the electrode may seal the tube with the body of the electrode to accomplish suitable acceleration and muzzle velocity. A rear face of the cylindrical body may receive substantially all of the propelling force.

An electrode may include a substantially cylindrical body. Prior to launch, the electrode is positioned in a substantially cylindrical tube slightly larger in diameter than the electrode. A propelling force (e.g., rapidly expanding gas) is applied to a closed end of the tube. The gas pushes against a rear portion of the body of the electrode to propel the electrode out of an open end of the tube toward a target.

An electrode includes a shape and a surface area for aerodynamic flight for suitable accuracy of delivery of the electrode across a distance toward a target, for example, about 15 to 35 feet from a launch device to a target. An electrode may rotate in-flight to provide spin stabilized flight. An electrode may maintain its pre-launch orientation toward a target during launch, flight to, and impact with a target.

In other implementations, an electrode has a conical shape (e.g., cone, golf tee, series of axially nested cones) with the base of the conical shape receiving the propelling force.

On impact, an electrode mechanically couples to a target. Mechanical coupling includes penetrating target clothing and/or tissue, resisting removal from clothing and/or tissue, remaining in contact with a target surface (e.g., tissue, hair, clothing, armor), and/or resisting removal from the target surface. Coupling may be accomplished by piercing, lodging (e.g., hooking, grasping, entangling, adhering, gluing), and/or wrapping (e.g., encircling, covering). An electrode, according to various aspects of the present invention, includes structure (e.g., hook, barb, spear, glue ampoule, tentacle, bolo) for mechanically coupling the electrode to a target. A structure for coupling may penetrate a protective barrier (e.g., clothing, hair, armor) on an outer surface of a target.

In one implementation, an electrode includes a body and a spear (e.g., pointed shaft, needle). The spear penetrates target clothing and/or tissue up to the length of the spear. The body arrests penetration. A spear extends away from the body toward the target. The spear may include one or more barbs for increasing the strength of the mechanical coupling of the electrode to the target. The barbs may be arranged to accomplish suitable mechanical coupling at various lengths of penetration of clothing and/or tissue.

An electrode is mechanically coupled to a filament to deploy the filament from storage and to extend the filament from the launch device to the target. Mechanical coupling includes coupling a filament and an electrode with sufficient strength to retain the coupling during manufacture, prior to launch, during launch, after launch, during mechanical coupling of the electrode to a target, and while delivering a stimulus signal to a target. A mechanical coupling may be established between a filament and an electrode in any conventional manner (e.g., threading the filament through a hole in the electrode and knotting the filament to prevent unthreading, tying the filament in a knot to a portion of the electrode, gluing the filament to the electrode, joining (e.g., welding, soldering) a portion of the filament to a portion of the electrode). Mechanical coupling may be accomplished by confining the filament in a portion of the electrode. For example, confining a portion of the filament in an interior of the electrode. Confining may include enclosing, holding, retaining, maintaining mechanical coupling, and/or resisting separation. Confining may be accomplished by preventing or resisting movement or deformation (e.g., stretching, twisting, bending) of the filament. As discussed below, placing the filament in an interior and affixing a spear over the interior in one implementation confines the filament to the interior.

An electrode facilitates electrical coupling of the launch device and the target. Electrical coupling generally includes a region or volume of target tissue associated with the electrode (e.g., a respective region for each electrode when more than one electrode is used). According to various aspects of the present invention, one or more structures of the electrode accomplish lower current density in the region or volume compared to prior art electrodes.

For each electrode, electrical coupling may include placing the electrode in contact with target tissue (e.g. touching, inserting) and/or ionizing air in one or more gaps between the launch device, the deployment unit, the filament, the electrode, and target tissue. For example, a placement of an electrode with respect to a target that results in a gap of air between the electrode and the target does not electrically couple the electrode to the target until ionization of the air in the gap. Ionization may be accomplished by a stimulus signal that includes, at least initially, a relatively high voltage (e.g., about 25,000 volts for one or more gaps having a total length of about one inch). After initial ionization, the electrode remains electrically coupled to the target while the stimulus signal supplies sufficient current and/or voltage to maintain ionization. Ionization may not be needed, for instance when contact is accomplished by spreading involving direct conduction from a filament to the target.

In an electrode, according to various aspects of the present invention, conduction of current from the electrode is enhanced at surface tissue of the target and diminished at the tip inserted in target tissue. These effects are accomplished by spreading and/or diffusing.

An electrode for use with a deployment unit and/or an electronic weapon, according to various aspects of the present invention, performs the functions discussed above. For example, any of electrodes 142, 143, 600, 700, and 800 of FIGS. 1-8 may be launched from weapon 100 toward a target to establish a circuit with the target to provide a stimulus signal through the target.

Electronic weapon 100 of FIG. 1 includes launch device 110 and deployment unit 130. Launch device 110 includes user controls 112, processing circuit 114, power supply 116, and signal generator 118. In one implementation, launch device 110 is packaged in a housing. The housing may include a mechanical and electrical interface for a deployment unit 130. Conventional electronic circuits, processing circuit programming, and propulsion and mechanical technologies may be used, suitably modified, and/or supplemented as discussed herein.

A user control is operated by a user to initiate an operation of the weapon. User controls 112 may include a trigger, a manual safety, and/or a touch screen user interface operated by a user. When user controls 112 are packaged separately from launch device 110, any conventional wired or wireless communication technology may be used to link user controls 112 with processing circuit 114.

A processing circuit controls many if not all of the functions of an electronic weapon. A processing circuit may initiate a launch of one or more electrodes responsive to a user control. A processing circuit may control an operation of a signal generator to provide a stimulus signal. For example, processing circuit 114 receives a signal from user controls 112 indicating user operation of the weapon to launch an electrode and provide a stimulus signal. Processing circuit 114 provides a launch signal 152 to deployment unit 130 to initiate launch of one or more electrodes. Processing circuit 114 may provide a signal to signal generator 118 to provide the stimulus signal to the launched electrodes. Processing circuit 114 may include a conventional microprocessor and memory that executes instructions (e.g., processor programming) stored in memory.

A power supply provides energy to operate an electronic weapon and to provide a stimulus signal. For example, power supply 116 provides energy (e.g., current, pulses of current) to signal generator 118 to provide a stimulus signal. Power supply 116 may further provide power to operate processing circuit 114 and user controls 112. For hand held electronic weapons, a power supply generally includes a battery.

A signal generator provides a stimulus signal for delivery through a target. A signal generator may reform energy provided by a power supply to provide a stimulus signal having suitable characteristics (e.g., ionizing voltage, charge delivery voltage, charge per pulse of current, current pulse repetition rate) to interfere with target locomotion. A signal generator electrically couples to a filament to provide the stimulus signal through the target as discussed above. For example, signal generator 118 provides a stimulus signal to electrodes 142-143 of deployment unit 130 via their respective filaments 140-141. Signal generator 118 is electrically coupled via stimulus interface 150 to filaments stored in deployment unit 130. The stimulus signal may consist of from 5 to 40 pulses per second, each pulse capable of ionizing air, each pulse delivering after ionization (if needed) about 80 microcoulombs of charge through a human or animal target having an impedance of about 400 ohms.

A deployment unit (e.g., cartridge, magazine) receives a launch signal from a launch device to initiate a launch of one or more electrodes and a stimulus signal to deliver through a target. A spent deployment unit may be replaced with an unused deployment unit after some or all electrodes of the spent deployment unit have been launched. An unused deployment unit may be coupled to the launch device to enable additional electrodes to be launched. A deployment unit may receive, via an interface, signals from a launch device to perform the functions of a deployment unit.

For example, deployment unit 130 may include one or more cartridges 132-134. Each cartridge 132 (134) may include one or more filaments 140 (141), one or more electrodes 142 (143), and one or more propellants 144 (145). A deployment unit stores a filament for each electrode or group of electrodes. Each filament mechanically couples to an electrode or group of electrodes as discussed herein. Via launch signal 152, processing circuit 114 initiates activation of propellant 144 (145) for one or more selected cartridges. Propellant 144 (145) propels one or more electrodes 142 (143) toward a target. Each electrode is coupled to deploy a respective filament from storage. As each electrode flies toward the target, each electrode deploys its respective filament out from its storage. Signal generator 118 provides the stimulus signal through the target via stimulus interface 150 and the filaments coupled to launched electrodes 142 (143).

Each propellant may serve to launch any number of electrodes. For instance, a deployment unit formed as a replaceable cartridge may include a housing, an electrical interface, two electrodes, one propellant for launching the two electrodes, and two filaments, one for each electrode.

An electrode, according to various aspects of the present invention, performs one or more of the following functions in any combination: binding the filament to the electrode, deploying the filament, mechanically coupling the electrode to a target, enabling conduction of the stimulus current from the filament through the target, spreading a current density with respect to a region of target tissue, and diffusing a current into a volume of target tissue. Enabling conduction includes ionizing, spreading, and/or diffusing. Enabling conduction, may include ionization of insulative material internal to one or more portions of the electrode. Enabling conduction may include ionization of insulative material external to the electrode. Insulative materials include any material or substance (e.g., gas, liquid, solid, aggregation, suspension, composite, alloy, mixture) that presents, at any time or times, a relatively high resistance to current of the stimulus signal.

Figure 2:
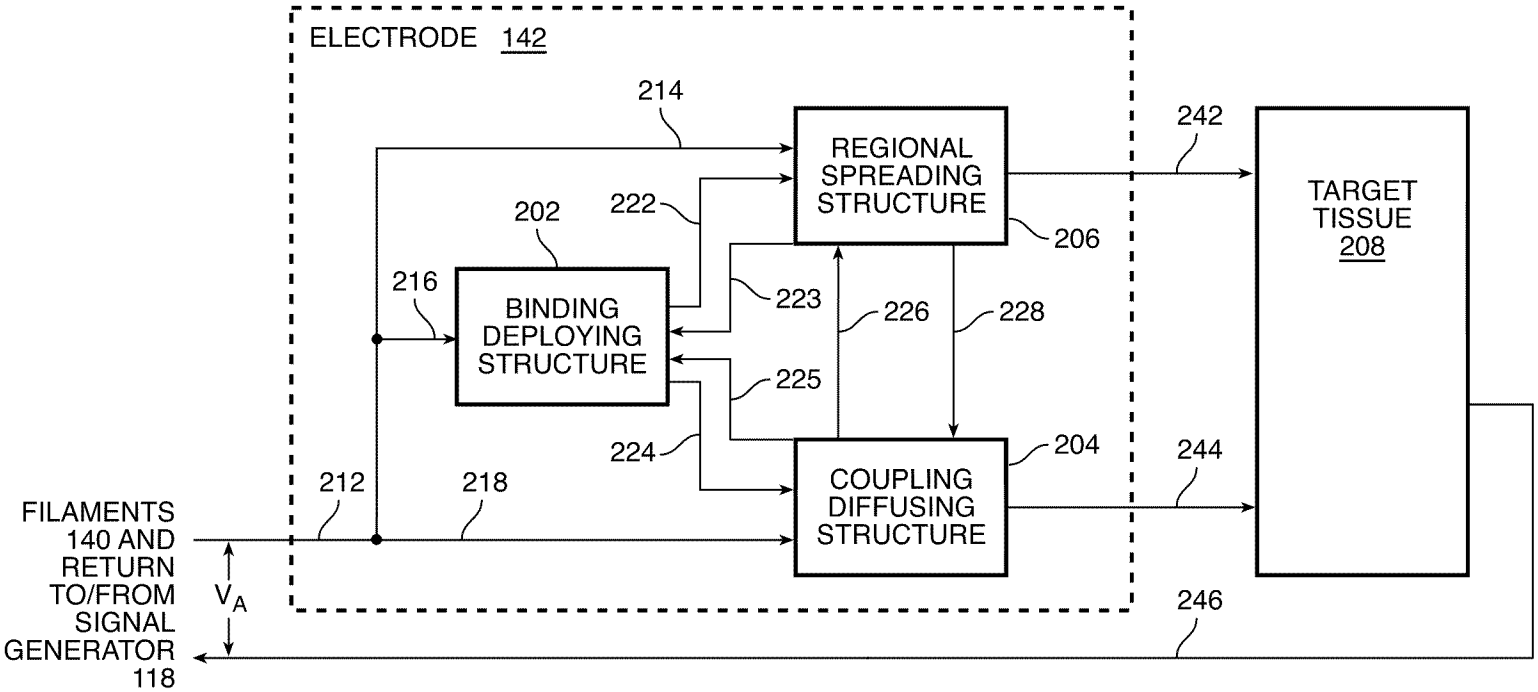
FIG. 2 is a functional block diagram of an electrode of the electronic weapon of FIG. 1.

A functional block diagram of an electrode, according to various aspects of the present invention illustrates functional and structural cooperation. Lines shown on FIG. 2 illustrate paths by which current is conducted. Arrows on these lines show a single polarity for current flow for clarity of description. Current of any conventional polarity or polarities may flow in one or more directions on any of the lines shown at various times. Return path 246 may be accomplished in any manner discussed above.

Electrode 142 includes binding and/or deploying structure 202; coupling and/or diffusing structure 204; and a regional spreading structure 206. Electrode 142 performs mechanical and electrical functions. Receiving and conducting the stimulus signal is herein called activation. Electrode 142 is activated via filament 140 with current to signal generator 118 and with current from target tissue 208 on one or more paths through electrode 142 and one or more paths through target tissue 208.

A binding deploying structure has mass, shape, and surfaces for being attached to a filament, for being propelled, and for deploying the filament to a target, as discussed above. Conventional mass, shape, and surfaces may be employed. For example, a binding structure may have a substantially cylindrical shape, an interior with surfaces that abut and/or grip a filament, and external surfaces with suitable aerodynamic properties for efficient propulsion and accurate flight to a target. A binding deploying structure may employ conductive, resistive, and/or insulative material on an intended path of conduction of stimulus current. A binding deploying structure may employ resistive and/or insulative material to diminish stimulus current conduction on undesired paths. Conventional metal and/or plastic fabrication technologies may be used in the manufacture of a binding deploying structure as discussed herein.

For example, binding deploying structure 202 binds an end portion of a filament (e.g., an insulated wire 140) for deploying the filament in response to propulsion (e.g., by propellant 144). In addition, binding deploying structure 202 may conduct the stimulus current as discussed in Table 1.

Diffusing facilitates formation and use of at least one current path for stimulus signal current through tissue of the target, subtracting from current that would otherwise pass into target tissue through a tip of the electrode. As a result of diffusing, stimulus current divides among the at least two current paths. Diffusing reduces electric field flux density in a volume of target tissue (e.g. near a tip). A structure of conventional materials may accomplish diffusing as discussed herein. Such a structure may have any shape known in the art for inserting an electrode into a volume of target tissue. A diffusing structure includes conductive material and may further include insulative material, for example, to inhibit ionization from undesired surfaces and/or locations of the diffusing structure.

A coupling diffusing structure accomplishes mechanical coupling of the electrode to the target (e.g., target's tissue, target's clothing) as discussed above. A coupling diffusing structure has a shape suitable for the mechanical coupling method(s) being implemented as well as shape and material suitable for electrical coupling (e.g., forming ionized paths, conducting stimulus signal current) and diffusing current density. Mechanical coupling may be accomplished with piercing. When piercing and lodging are used for coupling, the coupling diffusing structure may have one or more shafts of small diameter compared to the length of the shaft. Each shaft may include a tip sufficient to pierce material and/or tissue at the target. Lodging may be accomplished with any conventional irregularity of the surface of the shaft at the tip, spaced away from the tip, or continuing from the tip. Mechanical coupling may be accomplished without piercing. When coupling includes lodging and/or wrapping the coupling diffusing structure may have a relatively blunt surface for colliding with material and/or tissue at the target. For example, the blunt surface may have a relatively large adhering surface compared to a spear. A blunt surface may be long, as implemented with a tentacle deployed on impact that adheres to the target and/or adheres to itself.

For example, coupling diffusing structure 204 may include a spear comprising a shaft formed or joined to binding deploying structure 202. The shaft may terminate with a sharp tip. In addition, coupling diffusing structure 204 may conduct the stimulus current as discussed in Table 1.

Spreading facilitates formation and use of at least one current path for stimulus signal current through skin of the target, subtracting from current that would otherwise enter target tissue through a tip of the electrode. As a result of spreading, stimulus current divides among the at least two current paths. Spreading reduces electric field flux density in a volume of target tissue (e.g. near a tip). A structure of conventional materials may accomplish spreading as discussed herein. Such a structure may have any shape known in the art for spreading an electric field across a region or throughout a volume. A spreading structure includes conductive material and may further include insulative material, for example, to inhibit ionization from undesired surfaces and/or locations of the spreading structure.

A regional spreading structure improves the conductivity of a surface in a region near a point of impact of the electrode and the target. A regional spreading structure may dispense a conductive substance (e.g., liquid, gel, suspension, aggregate, powdered solid) to spread the current density of the stimulus signal into the region. The region may be immediately adjacent to a point of impact. The region may surround (e.g., encompass) the point of impact. The region may be spaced apart from the electrode and/or point of impact, for instance, separated from the electrode by a second interstitial region where conductivity is not improved by the regional spreading structure. An electrode may produce more than one point of impact. The region may be centrally located between points of impact. The region may have an area larger than an area that is subject to contact by blunt impact of the electrode.

For example, regional spreading structure 206 may comprise a container that supplies conductive material onto or into the region. The container may conduct the stimulus current into the conductive material. Because spreading may be a consequence of the conductivity of the material dispensed, the container may spread the stimulus current density without supplying the stimulus current to the material dispensed. See Table 1 for illustrative implementations.

The seven configurations of Table 1 provide guidance for construction of at least seven electrodes. The techniques illustrated by these configurations may be combined in any practical manner for construction of additional electrodes. Current division may be described as a ratio of the currents 242 and 244. Zero or more of the paths 212 through 244 may require ionization to become effective. Zero or more of the paths may be constructed to include a resistance. A suitable ratio may be accomplished by adjusting ionization (e.g., quantity of gaps, gap length(s)) and/or resistance of one or more paths 212 through 244. For example, the structures of electrode 142 in one implementation enables a relatively low voltage of the stimulus signal to effect path 214/242, a relatively higher voltage to effect path 216/242 or 216/244, and a still higher voltage to effect path 218/244.

Current 242 may be expressed as a percentage of total current I (e.g., {100*i(242)}/{i(242)+i(244)}). A non-zero percentage provides beneficial reduction of electric field strength at an electrode tip inserted in target tissue. According to various aspects of the present invention, greater percentages are even more beneficial. In one implementation, the percentage is in the range of from about 50% to about 99%. In other implementations, the percentage is in the range of from about 20% to about 80% due to limitations of structural strength and economics of material costs and manufacturing.

TABLE 1

| Configuration | Activation Sequence Accomplishing Division Of Current Through Target 208 (via 242 and 244) |
|---|---|
| 1 | Filament 140 activates (216) binding deploying structure 202 which activates (224) coupling diffusing structure 204 for current 244. Coupling diffusing structure 204 activates (226) regional spreading structure 206 for current 242. |
| 2 | Filament 140 activates (216) binding deploying structure 202 which activates (222) regional spreading structure 206 for current 242. Regional spreading structure 206 activates (228) coupling diffusing structure 204 for current 244. |
| 3 | Filament 140 activates (216) binding deploying structure 202 which activates (224, 222) both coupling diffusing structure 204 for current 244 and regional spreading structure 206 for current 242. |
| 4 | Filament 140 activates (218) coupling diffusing structure 204 for current 244. Coupling diffusing structure 204 activates (226) regional spreading structure 206 for current 242. |
| 5 | Filament 140 activates (218) coupling diffusing |

TABLE 1-continued

| Configuration | Activation Sequence Accomplishing Division Of Current Through Target 208 (via 242 and 244) |
|---|---|
| | structure 204 for current 244. Coupling diffusing structure 204 activates (225) binding deploying structure 202 which activates (222) regional spreading structure 206 for current 242. |
| 6 | Filament 140 activates (214) regional spreading structure 206 for current 242. Regional spreading structure 206 activates (228) coupling diffusing structure 204 for current 244. |
| 7 | Filament 140 activates (214) regional spreading structure 206 for current 242. Regional spreading structure 206 activates (223) binding deploying structure 202 which activates (224) coupling diffusing structure 204 for current 244. |

In various implementations according to Table 1, structures 202-206 may be implemented using conventional manufacturing technologies (e.g., molding, casting, machining, joining, crimping, staking, fastening, adhering, coating, over molding, abutting, assembling) as needed to support conductivity for the desired one or more paths 212-244. Current paths shown schematically on FIG. 2 adjacent to a gap may be subsumed in structures adjacent to the gap.

When more than one path of paths 212-244 is formed, stimulus current divides among the formed paths (an inclusive OR of the paths 212-244). Due to changes in the environment of the electrode (e.g., movement of the electrode and/or the target with respect to the other), changing signal generator output voltage $V_A$, changes in the conductivity of target tissue), one or more of paths 212-244 may form, decay, and/or reform over time (e.g., during a series of pulses of stimulus current).

An electrode according to various aspects of the present invention may have one or more binding deploying structures 202 (e.g., more than one filament for redundancy, one for each of several stimulus signals), one or more coupling diffusing structures 204 (e.g., increased lodging capability with decreased depth of piercing tissue), and/or one or more regional spreading structures 206 (e.g., plural spreading structures symmetrically arranged around the shaft of one spear, one or more spreading structures for each of several coupling diffusing structures).

In operation with one of each structure as shown, a voltage $V_A$ is impressed by signal generator 118 across a filament 140 (212) and a return path 246. The return path may be through earth or through a second electrode (not shown) analogous to electrode 140. Current (I) may flow through target 208 by any one or more paths 242-244.

Figure 3:
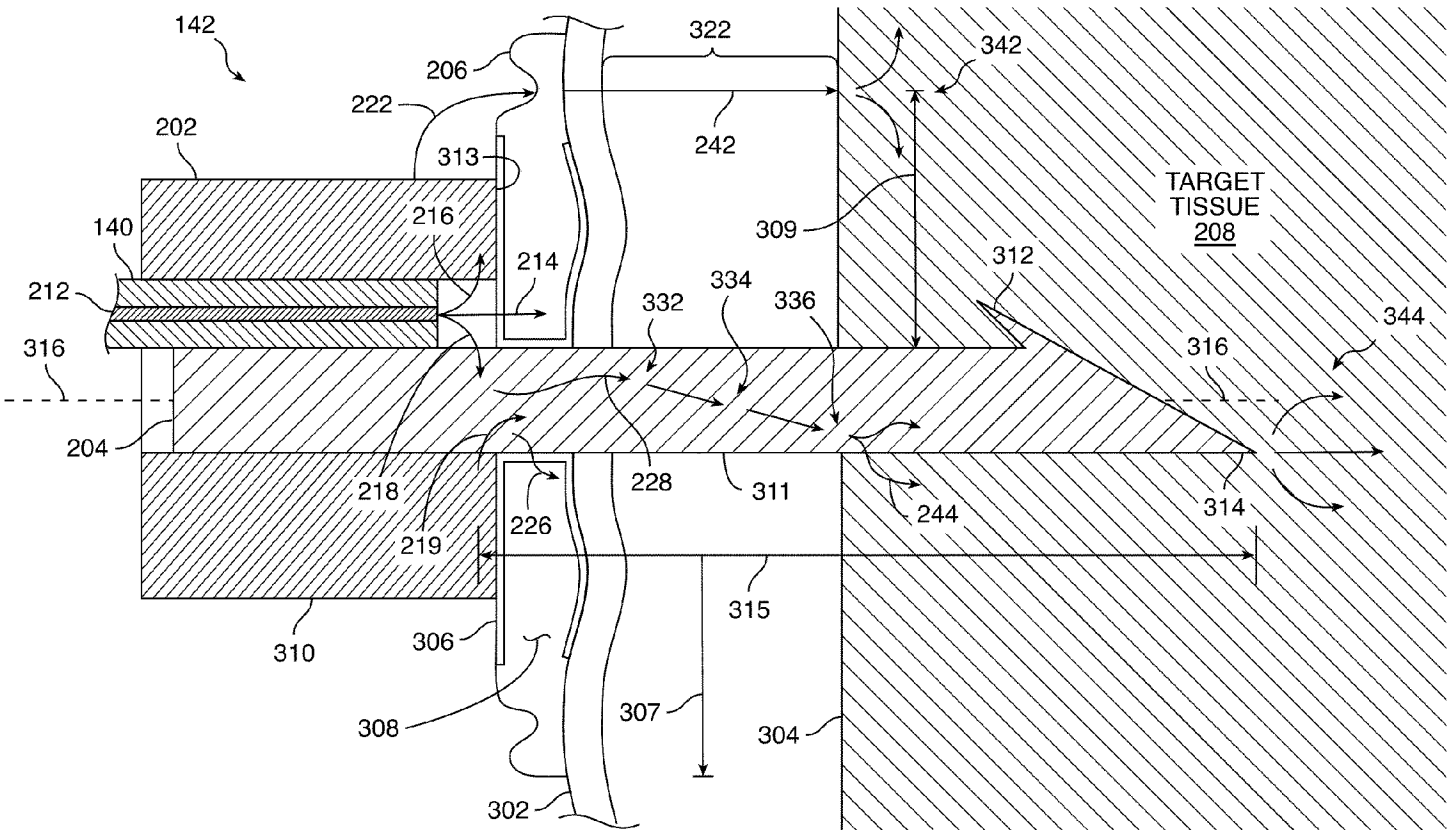
FIG. 3 is a cross-section diagram of an impact with target tissue of an electrode in one implementation according to FIG. 2.

An example impact of one implementation of electrode 142 is shown in cross section in FIG. 3. Electrode 142 has a central axis 316. As shown, binding deploying structure 202 maintains a rigid arrangement of itself, an end portion of filament 140 and an end portion of coupling diffusing structure 204. Filament 140 comprises a coaxially insulated conductor 212. Conductor 212 is exposed to the atmosphere near binding deploying structure 202, coupling diffusing structure 204, and regional spreading structure 206. As shown, electrode 142 has made impact with target 208 by piercing a surface of the target, namely, clothing 302 that remains a distance 322 (exaggerated merely for clarity of presentation) away from skin 304 of the target. Regional spreading structure 206 has deformed on impact with the target.

Binding deploying structure 202 includes a cylindrical body 310 and a front face 313 both symmetric about axis 316. Body 310 retains filament 140 and coupling diffusing structure 204 by friction. Body 310 may be conductive (as shown).

Coupling diffusing structure 204 includes a shaft 311, a tip 314, and a barb 312. Shaft 311 has a longitudinal axis aligned with axis 316. Coupling diffusing structure 204 is conductive at voltages above an activation voltage.

Coupling diffusing structure 204 may be activated by any one or more of currents 216 and 219 through body 310, and 218 from filament 140 at a locale a distance 315 from tip 314. Tip 314 may be activated via any current in shaft 311, provided sufficient activation voltage is available.

In one implementation, activation of tip 314 involves a series circuit comprising intrinsic resistance of shaft 311 and/or one or more gaps (e.g., series 332, 334, and 336) each gap requiring ionization for current to freely flow. Ionization occurs internally to shaft 311. Assuming sufficient activation voltage to activate shaft 311 to a locale near skin 304, a portion 244 of current in coupling diffusing structure 204 enters target tissue. An activation voltage of tip 314 is higher than the activation voltage to produce current 244 due to additional length of intrinsic resistance and/or additional gaps (not shown) in the material of shaft 311, gaps 332, 334, and 336 being illustrative of a principle of activation. Consequently, a portion of current 228 in coupling diffusing structure 204 is inhibited from flowing through tip 314 by intrinsic resistance and/or gaps and enters target tissue at a locale different from tip 314 (e.g., current 244 near skin 304). Current 344 flows in a volume of target tissue 208. Current 344 and an associated electric field flux density at tip 314 are consequently less in comparison to a shaft, barb, and tip formed of highly conducting material (e.g., stainless steel as in the prior art).

Regional spreading structure 206 comprises a container 306 formed of insulative material and a conductive gel 308. On impact, the container deforms, ruptures, and dispenses the gel away from coupling diffusing structure 204 and away from axis 316 of electrode 142. The gel makes conductive contact with the surface 302 up to a distance 307 from coupling diffusing structure 204. In one implementation, distance 307 is greater than a radius of electrode 142 from axis 316. Gel 308 may be activated by any one or more of currents 222, 214, and 216 at an activation voltage that depends at least in part on the conductive or insulative properties of the materials of binding deploying structure 202, container 306, and shaft 311. Current 242 enters skin 304 a distance 309 away from coupling diffusing structure 204. Currents 342 flow in a volume of target tissue 208.

In another implementation, a relatively low viscosity conductive material (e.g., liquid) may substitute for conductive gel 308 to permit flow through clothing 302. Conductive gel 308 may cause clothing 302 to adhere to skin 304 by virtue of wetting, surface tension, electrostatic attraction, and/or chemical adhesion.

In operation after impact, electrode 142 inhibits current 344 through tip 314 by spreading and diffusing to enable currents 242, 342, and 244 not through tip 314. Currents 342 and 244 exist in response to electric field flux density in the locale of each current. The structures of electrode 142 diffuse and spread the electric field flux density that would otherwise occur at tip 314 by diffusing current through any locale of shaft 311 in contact with target tissue (the locale at current 244 for example), by inhibiting activation of tip 314 through use of materials in shaft 311 and/or tip 314 that are not highly conductive, and/or by enabling current flow 342 at a distance from the electrode through use of regional spreading.

Activation of shaft 311 and current 244 occurs at a voltage lower than an activation voltage of tip 314. Current 244 is representative of currents from shaft 311 at any locale where shaft 311 is in contact with target tissue 208. Other currents from shaft 311 (not shown) may be activated at respective activation voltages that are less than the activation voltage of tip 314. In one implementation, such activation voltages are inversely proportional to distance of the respective locale from tip 314. Proportionality may be linear or nonlinear as a result of choice of insulative materials and manufacturing techniques used to form and assemble structure 204.

Activation of regional spreading structure 206 occurs at a voltage lower than an activation voltage of tip 314. Activation of regional spreading structure 206 may occur at a voltage lower than an activation voltage associated with current 244 (representing currents from shaft 311 not at tip 314). As a result, at preferred operating voltages for electrode 142, current 342 may have a magnitude greater than current 244 (representing currents from shaft 311 not at tip 314); and/or current 342 may have a magnitude greater than a sum of magnitudes of currents 244 and 344.

Figure 4:
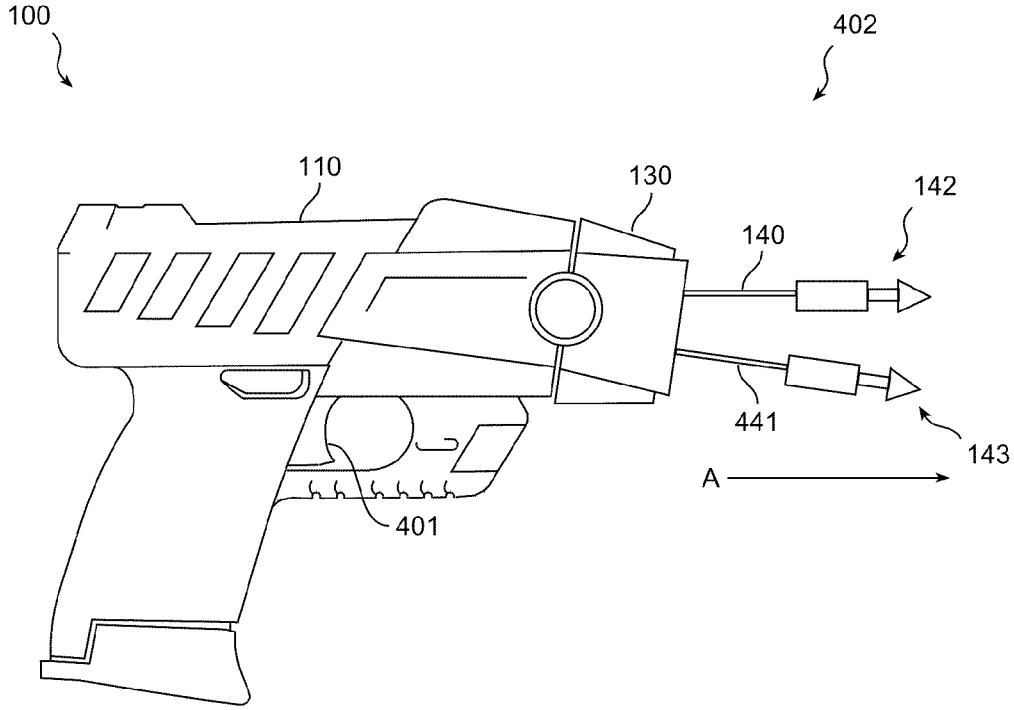
FIG. 4 is a side plan view of an implementation of the electronic weapon of FIGS. 1 and 2.

An electronic weapon 100, according to various aspects of the present invention, may launch two electrodes each of the type discussed herein with reference to electrode 142, where one electrode serves in the return path, as discussed above. For example, electronic weapon 100 of FIG. 4 is shown immediately after a user initiated launch of two electrodes from a deployment unit. Electronic weapon 100 includes a hand-held launch device 110 that receives and operates one field-replaceable cartridge 130 as a type of deployment unit. Launch device 110 houses a power supply (having a replaceable battery), a processing circuit, and a signal generator as discussed above. Launch device 110 may be of the type known as a model X26 electronic control device marketed by TASER International, Inc. Cartridge 130 includes a plurality 402 of tethered electrodes including electrodes 142 and 143. Upon operation of trigger 401, electrodes 142 and 143 are propelled from cartridge 130 generally in direction of flight "A" toward a target (not shown). As electrodes 142 and 143 fly toward the target, electrodes 142 and 143 deploy behind them filaments 140 and 441 respectively. When electrodes 142 and 143 are positioned in or near the target, filaments 140 and 441 extend from cartridge 130 to electrodes 142 and 143 respectively. The signal generator provides a stimulus signal through the circuit formed by filament 140, electrode 142, target tissue, electrode 143, and filament 441. Electrodes 142 and 143 mechanically and electrically couple to tissue of the target as discussed above.

Figure 5:
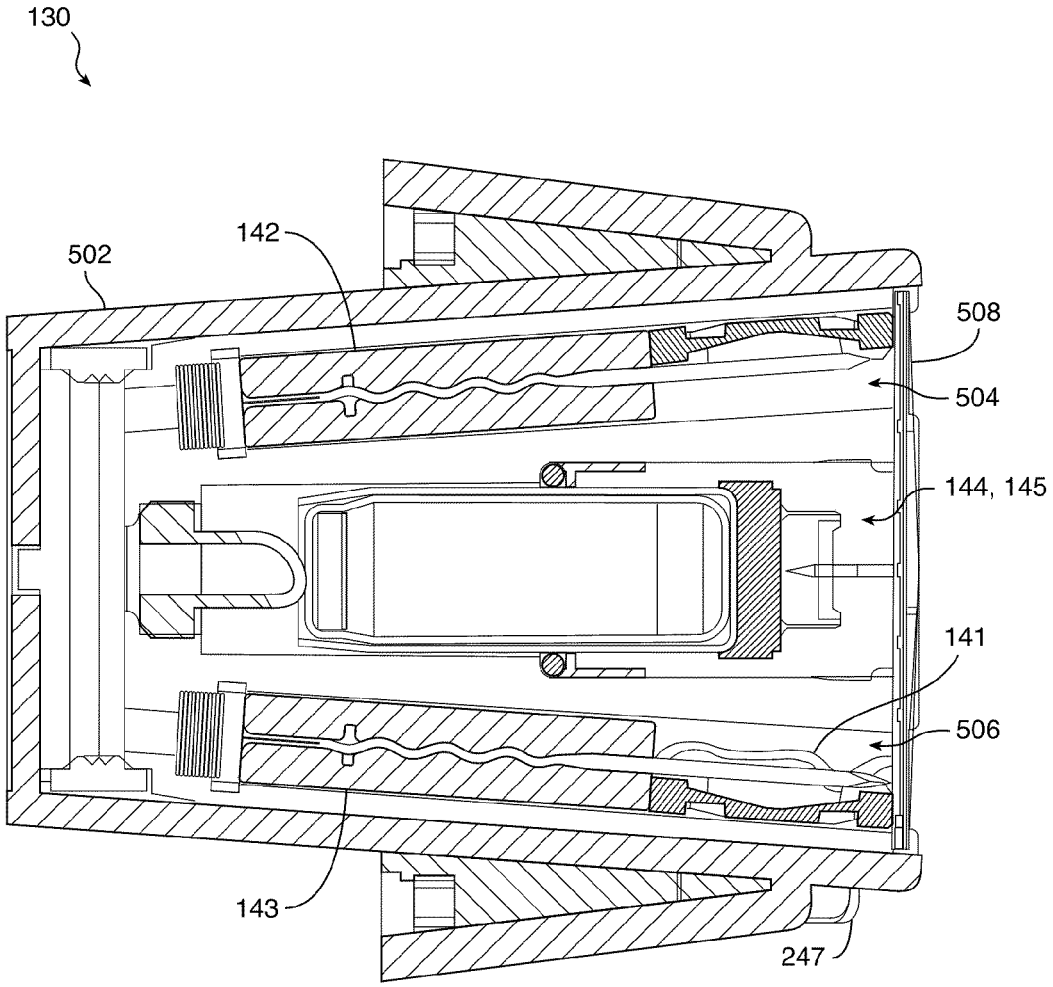
FIG. 5 is a cross-section view of the deployment unit of the electronic weapon of FIG. 4.

A deployment unit may substantially simultaneously deploy a plurality of electrodes. For example, deployment unit 130 of FIG. 5 includes the exterior dimensions, features, and operational functions, of a conventional cartridge of the type used with model M26 and X26 electronic control devices marketed by TASER International, Inc. FIG. 5 is drawn to scale with the angle formed by the launch tubes being 8 degrees. For deployment unit 130, two electrodes are simultaneously propelled from respective cylindrical launch tubes (e.g., bore, chamber) in a housing of the deployment unit. For example, deployment unit 130 includes housing 502, cover 508, filament storage (not shown), bores 504 and 506, propellant system 144, 145 comprising several components, and tethered electrodes 142 and 143. Each tethered electrode 142 (143) is mechanically coupled to a respective filament (one shown) 141, to deploy the filament with the electrode. Spaces for filament storage are located on both sides of the plane of the bores of the housing, so that in the cross-section view of FIG. 5, one storage space is removed by cross section and the other is hidden. In use, the propellant explosively provides a volume of gas that pushes each electrode 142 (143) from the respective bore 504 (506). Acceleration, muzzle velocity, flight dynamics, and accuracy of hitting the target are affected by the fit of the body as it leaves the bore. Any diameter along the length of the body that exceeds a limit interferes for a period of time unnecessarily with propelling the body from the bore.

Portions of an electrode, as discussed above, may be formed, according to various aspects of the present invention, of materials that are not highly conductive. These materials are discussed above as resistive and/or insulative. The structure of these materials may be uniform through a volume or nonuniform. When uniform, electrical activation may be in accordance with a resistance per unit length and one or more lengths of conduction (path lengths) needed to accomplish suitable activation. Nonuniformity may be accomplished by varying the blend of constituents of the material when molding the desired structure, or by arranging materials of different properties in series assembly. Nonuniformity may cause resistance to increase away from the target or to any desired nonlinear extent. Conductive and/or resistive materials may be combined with insulative materials in any conventional fashion.

Insulative materials include nonconductors. When exposed to ionization voltages, portions of insulative materials along paths of ionization may reform (e.g., wear, deform, mobilize, melt, vaporize, temper, congeal, crystallize, stratify, reconstitute) into resistive materials, voids, and/or pockets of component materials (e.g., liquids or gases). Reformation may change a magnitude of voltage needed for a desired activation. Insulative materials may comprise plastic, nylon, fiberglass, or ceramic. Insulative coatings include lacquer, black zinc, a dielectric film, a non-conductive passivation layer, a polyp-xylylene polymer (e.g., Parylene), polytetrafluoroethylene (e.g., Teflon), a thermoplastic polyamide (e.g., Zytel). Conventional insulative technologies may be used.

Insulative materials of a type herein called composite materials, may include separated conductors. Conventional composite materials are manufactured and used for molding and overmolding. For example, a composite material may be formed from a liquid resin, plastic, or thermoplastic as a host material with solid fibers, spheres, ellipsoids, powder, or other particles as filler mixed into the host before the host cures to a solid. Host material may be plastic, nylon, PEEK (polyetheretherkeytone), thermoplastic elastomer (e.g., thermoplastic polyurethane (TPU)), SBS poly(styrene-butadiene-styrene) rubber. Particles of conductive (e.g., metal, stainless steel, tungsten) or resistive (e.g., carbon) material may be used as filler. Particles having a coating of conductive or resistive material may be used as filler. For example, insulative material of the type marketed by RTP Co. as thermoplastic polyurethane elastomer (TPUR/TPU) comprising nickel-coated carbon fiber may be used. Spheres or powder may have a diameter of from about 3 to about 11 microns. Fibers may have a similar diameter and a length of from about 5 to about 7 millimeters. Filler to host by weight may be from about 5% to about 40% to assure separation (nonoverlap) of particles. Composition may result in activation voltages of from about 50 volts to about 6000 volts for components of electrodes 142.

In one exemplary implementation in accordance with the functions discussed above with reference to FIGS. 1-5, binding deploying structure 202 is implemented as a body, coupling diffusing structure 204 is implemented as a spear having a shaft and a tip, and regional spreading structure 206 is implemented as a container that contains an amorphous conductor.

The body and spear may be of dissimilar materials. Forming the body comprising a material with significant ductility (e.g., a zinc alloy) may facilitate binding of the filament and/or assembling of the filament and the body. Forming the spear comprising a material with significant hardness (e.g., a stainless steel alloy) may facilitate forming a tip for piercing and a barb for lodging.

A body may perform binding and deploying as discussed above. A body may have any size and shape known in the art for suitably binding a filament and deploying a filament (e.g., substantially spherical, substantially cylindrical, having an axis of symmetry in the direction of flight, bullet shaped, tear drop shaped, substantially conical, golf tee shaped). In various implementations, a body may be conductive, resistive, or insulative. If insulative, the body may comprise composite material and/or be coated with insulative material.

A spear may perform mechanical coupling and diffusing as discussed above. A spear may have any size and shape known in the art for suitably piercing material and/or tissue of a target, lodging in material and/or tissue of a target, and forming an ionized path from the tip of the spear to target tissue. In various implementations, a spear may be resistive or insulative. When insulative, the body may comprises composite material and/or be coated with insulative material. Activation and use of a shaft and/or tip may reform paths through the insulative material.

A container includes any structure that maintains the shape of an amorphous substance. A container may be formed to rupture on impact with a target by being thin, brittle, scored, and/or pre-stressed. Rupture may be designed to dispense the substance uniformly or in jets. Conventional materials may be used, such as those adapted for sports involving paint balls. For example, a thin brittle plastic (e.g., polystyrene) may be used.

The container may be formed with locales where activation is desired. For example, activation by current 226 in FIG. 2 may be encouraged by an electrical weakness of the container near shaft 311.

An amorphous conductor includes any substance with suitable electrical properties to serve as a conductor for the stimulus signal (e.g., ionization current, muscle stimulus current). The amorphous conductor may comprise a liquid, paste, gum, or gel. For example, a hydrogel of the type used for medical testing electrodes may be used. A gel marketed by Ludlow Technical Products (e.g., GRG73P) may be used.

According to various aspects of the present invention, a ratio of the current delivered through target tissue via a coupling diffusing structure to the current delivered through target tissue via a regional spreading structure is designed to account for expected target impact and expected reformation of materials of the electrode. The ratio may decrease over time responsive to reformation when materials of the coupling spreading structure are more subject to reformation than other structures such as the regional spreading structure.

A launcher with signal generating capabilities that suitably adjust to reformation of electrode materials may be used. The voltage applied to an electrode may be adjusted to control (e.g., regulate, mitigate, encourage, limit, respond to) reformation of the material of the body and/or the spear. A voltage applied ($V_A$) may assure sufficient charge is delivered through target tissue. For example, electrodes as discussed here may be used with a launcher as described in any of the following: U.S. Pat. No. 7,457,096, publications US-2008/158769-A1, and/or US-2008-0259520-A1, each incorporated by reference in its entirety for any purpose.

A regional spreading structure may form a region of relatively higher conductivity as a consequence of impact with the target. Such a region, according to various aspects of the present invention, may have an area larger than an area of the body (e.g. a front, face, contact surface) that is in contact with the regional spreading structure. In addition, a regional spreading structure may absorb and/or dissipate kinetic energy of the electrode to reduce blunt impact trauma to tissue of the target.

In one implementation, the regional spreading structure is implemented as one or more containers of conductive material. A voltage of the stimulus signal may ionize air in a gap between the conductor of a filament and the conductive portion of a regional spreading structure to establish an electrical coupling for a duration of ionization in the gap. Due to the small dimensions of the gap between the conductor of the filament and a regional spreading structure, a relatively low voltage (e.g., 200V-400V) stimulus signal may activate the regional spreading structure, traversing any intervening material and/or ionizing relatively short air gaps.

A spear may include an insulator. An insulator may insulate all or any portion of a spear. A spear may be partially or entirely formed of a material that electrically insulates. An insulator may be of a type (e.g., thickness, material, structure) that electrically insulates the spear against a current having a voltage below a threshold, but fails to insulate the spear against a current having a voltage above the threshold. An insulator may be formed (e.g., shaped, applied, positioned, removed, partially removed, cut) to establish a likely location on the spear where the insulator may fail to insulate against a current having a voltage above a threshold. An insulator may be positioned on or near a spear relative to a regional spreading structure. An insulator may define a series of gaps between conductors of the spear or conductive portions of the spear. The gaps may act as switches operative to conduct in response to the applied voltage of the stimulus signal.

A regional spreading structure may include an insulator. An insulator may insulate all or any portion of a regional spreading structure. A regional spreading structure may be partially formed of a material that electrically insulates. An insulator may be of a type (e.g., thickness, material, structure) that electrically insulates the regional spreading structure against a current having a voltage below a threshold, but fails to insulate the regional spreading structure against a current having a voltage above the threshold. An insulator may be formed to establish a likely location on the regional spreading structure where the insulator may fail to insulate against a current having a voltage above a threshold. An insulator may be positioned on or near a regional spreading structure relative to a spear. When the regional spreading structure includes a container, the container may comprise insulative material. By dispensing conductive material away from an insulated interface between the regional spreading structure and a surface of the target (e.g., clothing, tissue), the current spreading function of the regional spreading structure is accomplished beginning at a substantial distance from the electrode (e.g., at a distance greater than a diameter of the spear, at a distance greater than a diameter of the body, at a distance greater than a diameter of the regional spreading structure prior to impact with the target).

A tip (e.g., point, cone, apex comprising acute angles between faces, end of a shaft of relatively small diameter) operates to pierce an outer surface (e.g., layer) of a target and/or target tissue. A tip of a spear facilitates mechanical coupling by piercing and lodging. A tip when insulated may operate as a gap or switch interfering with current flow (e.g., blocking) until a threshold voltage breaks down the insulator and/or permits ionization near the tip followed by current flow through the tip.

A barb operates to lodge (e.g., retain) an electrode in clothing, armor, and/or tissue of a target to retain a mechanical coupling between the barb and the target. A barb portion of a spear resists mechanical decoupling (e.g. separation or removal from the target). A spear may include a barb near the tip. A spear may include a plurality of barbs arranged at increasing distance from the tip. A barb may include a continuous surface of the spear (e.g., a helical channel or ridge, a screw thread or channel, a surface having an undulation that increases friction between the barb and the target.

A path may include an electrical coupling established through physical contact of conductors and/or ionization across one or more gaps between conductors. A gap may include insulation of the electrode, air, clothing, armor, skin, fur, hair, and/or target poorly conducting portions of tissue.

Electrode 142 may include a shaft having a tip and one or more barbs not located at the tip. Such a barb or barbs may include a surface for retaining the electrode in the target. Such a surface may provide mechanical coupling and may further provide electrical coupling of the shaft (or a locale of the shaft) and target tissue adjacent to the shaft (adjacent to the locale of the shaft).

Figure 6:
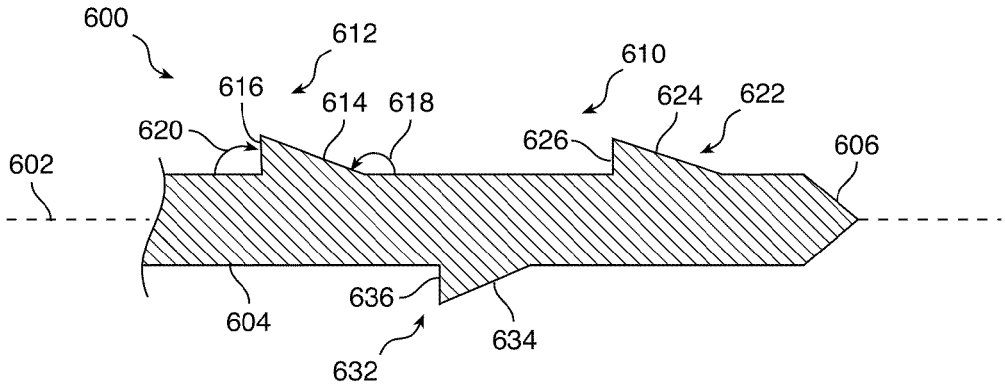
FIG. 6 is a cross-section of an electrode in a first implementation of the electrode of FIG. 2.

For example, an electrode may include a spear 600, shown in part in FIG. 6. Spear 600 includes shaft 604 and tip 606. A longitudinal axis 602 passes through a center of shaft 604 and a center of tip 606. Shaft 604 may be cylindrical or any conventional geometric shape in cross-section through axis 602. Shaft 604 includes a plurality 610 of barbs formed with or assembled onto shaft 604. For example, three barbs 612, 622, and 632 are shown but any suitable number of barbs may be used. Barbs may be arranged in symmetry about axis 602 and at a series of increasing distances from tip 606. Separations may be uniform in distance.

Each barb 612 (622, 632) includes a surface 614 (624, 634) facilitating piercing of a surface of the target (e.g., clothing, fur, skin), for example by sloping away from axis 602 at an obtuse angle 618 (e.g., greater than 90 degrees). Each barb 612 (622, 632) further includes a surface 616 (626, 636) that inhibits removal of shaft 604 from the surface of the target, for example by sloping away from axis 602 at an angle 620 of 90 degrees or less.

Barbs 610 may form a continuous surface about axis 602, for example, as a helical screw thread.

In another implementation, each barb (612) completely encircles axis 602 to form a ring or cone shape.

Surfaces 614 (624, 634) and/or 616 (626, 636) may be conductive to facilitate electrical coupling of stimulus signal current and target tissue. When shaft 604 is formed of insulative materials, one or more of barbs 612, 622, and 632 may be activated by ionization to a conductive surface of each barb, for example ionization from barb to barb toward target tissue. The sharp point of a barb may support a suitable electric field flux density, facilitating ionization.

Spear 600 may be formed of resistive material. In such case, a voltage for activation of tip 606 is greater than a voltage to activate one or more barbs 610. The resistance per unit length may be constant, increase linearly toward tip 606, or increase in a nonlinear manner toward tip 606.

Spear 600 may be formed of a composite material. Spear 600 may diffuse current into target tissue in any locale of shaft 604 in contact with target tissue. Due to division of current as discussed above, current into target tissue through tip 606 is inhibited by diffusion.

Diffusion may occur after insertion of a portion of spear 600 in target tissue. The barbs of spear 600 may accomplish current spreading by ionization from the barb to target skin when spear 600 (or a portion thereof) is not inserted into target tissue.

Electrode 142 may include a spear formed or assembled to include rings. Each ring may facilitate coupling of the stimulus current to target tissue. Activation of a ring may require a voltage sufficient to ionize air in a gap between a source of the current and the ring. Activation of a series of rings by a series of ionization paths from ring to ring toward target tissue may implement diffusion as discussed above. Ionization paths between rings are external to spear 700.

Figure 7:
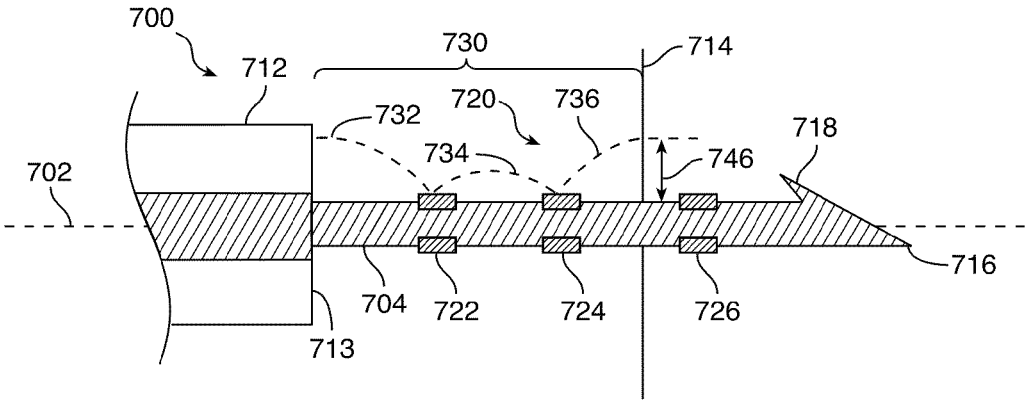
FIG. 7 is a cross-section of an electrode in a second implementation of the electrode of FIG. 2.

For example, electrode 700, a portion shown in cross-section in FIG. 7 after impact with target tissue 714, includes body 712, a spear having shaft 704, barb 718, and tip 716. A longitudinal axis 702 passes through a center of shaft 704. Shaft 704 may be cylindrical or any conventional geometric shape in cross-section through axis 702. Shaft 704 includes a plurality 720 of conductive ring formed with or assembled onto shaft 704. For example, three rings 722, 724, and 726 are shown, but any suitable number of rings may be used. Rings 720 may be arranged at a series of increasing lengths from tip 706. Any suitable lengths may be used. Due to the lengths as shown, activation of target tissue 714 occurs at a voltage less than an activation voltage of ring 726.

Shaft 704 may be formed of resistive material or composite material provided an insulative barrier (not shown) is included between rings 720. Shaft 704 may diffuse current into target tissue in any locale of shaft 704 in contact with target tissue.

Shaft 704 may be formed or assembled of insulative material. Shaft 704 may diffuse current into target tissue in any locale of shaft 704 in contact with target tissue. Due to division of current as discussed above, current into target tissue through tip 716 is inhibited by diffusion.

Rings 722, 724, 726 may be formed of a conductive metal or conductive alloy of metals. When rings are formed of resilient material, they may be snapped onto shaft 704. Rings may be formed of composite material that includes conductive material or formed of material that is treated to include a conductive surface.

In operation, body 712 of electrode 700 may activate the series of rings 722, 724 by supporting ionization on paths 732 and 734. Ionization of path 736 accomplishes spreading as discussed above as current enters skin 714 at a distance 746 from shaft 704. Path 736 may form as a cone due to the circular symmetry of ring 736.

Electrode 142 may include a body having an insulative coating, a shaft comprising conductive and insulative materials further comprising an insulative coating, a tip formed from the shaft, and a regional spreading structure comprising a torus shaped conductive material. On impact of the electrode and a surface of the target, the regional spreading structure deforms to provide a film between the body and the surface of the target to promote conductivity of stimulus current into target tissue at a distance from the tip. The insulative coatings inhibit ionization and currents between electrodes in a cartridge prior to deployment. The insulative coating on the shaft may improve resiliency, resistance to breakage, and/or sheer strength of the shaft. The regional spreading structure may collapse to form a film and/or rupture an outer surface to expose and/or dispense a film of conductive material. The outer surface may be provided by a container formed of insulative material. Voids in the container may facilitate activation of the conductive film and exit of current from the film both at suitable locations with respect to the filament, body, and shaft.

Electrode 142 may employ a spreading structure abutting a face of a body and/or a diffusing structure extending in front of a face of a body. By locating the spreading structure abutting the face, impact with the target may cause deforming and/or dispensing to facilitate spreading. By extending a diffusing structure in front of a face, insertion of the diffusing structure may be arrested by the face.

Figure 8:
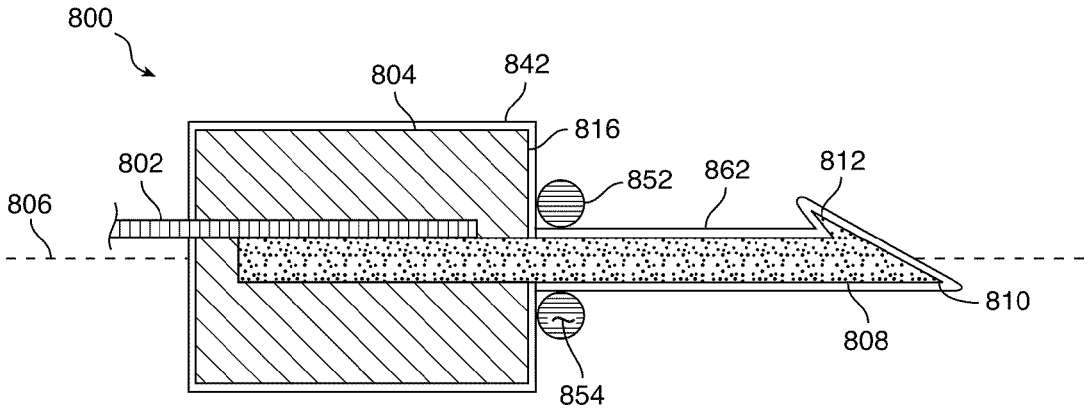
FIG. 8 is a cross-section of an electrode in a third implementation of the electrode of FIG. 2.

For example, electrode 800, shown in FIG. 8, includes body 804 and spear 805. Body 804 retains filament 802 and shaft 808 in any manner as discussed above. Spear 805 includes shaft 808, tip 810, and barb 812. Electrode 800 has a longitudinal axis through a center of body 804 and a center of shaft 808. Shaft 808 supports regional spreading structure 852, shaped as a torus and located against front face 816.

Body 804 may be formed of a conductor (e.g., a conductor (e.g., metal, stainless steel, brass, aluminum, zinc alloy. An insulative coating 842 may be used to inhibit ionization between electrodes prior to deployment. For the same reason, barb 812, tip 810 and a portion of shaft 808 extending from tip 810 to forward face 816 of body 804 may be covered with an insulative coating 862. The insulative coating may be formed of a conventional material (e.g., paint, Parylene, anodize, black zinc, oxide, powder coat, plastic). Insulative materials 862 and 842 may overlap or be coextensive. Ionization and reformation of the insulative coatings 842 and/or 862 may be intended and accomplished with suitable activation voltage.

Insulative material 862 may accomplish electrical insulating and structural strengthening purposes. For example, when material of shaft 808 is brittle, a silicone envelope may be overmolded on spear 805. The envelope acts as an insulative coating 862. The envelope also acts to maintain the electrical properties of shaft 808, in spite of, for instance, possible fracture on impact with target. Silicone provides a resilient support to shaft 808 inhibiting fracture and maintaining fractured portions proximate for conduction of the stimulus signal with ionization.

Body 804 may be formed of an insulative material (e.g., plastic, ABS, polycarbonate, nylon, high density plastic) when currents through body 804 are not needed for activation of target tissue.

Body 804 may be formed of composite material. (e.g., resin based material with conductive filler). The body may exhibit an activation voltage for forming a path for continued current flow and/or an activation voltage for stimulating tissue of the target. Activation for either purpose may be associated with an initial voltage (e.g., threshold, breakdown, set-up, reformation) below which current sufficient for the purpose is not conducted through the body and after which maintaining the initial voltage is not required. As examples, body 804 may be formed and/or covered to operate with an initial voltage for activation of forming a path to target tissue in the range of about 100 volts to about 25,000 volts. Body 804 may be formed and/or covered to operate with an initial voltage for activation of stimulating tissue in the range of about 100 volts to about 5,000 volts. Meeting or exceeding an activation voltage and/or conducting ionization and/or stimulation current may reform a material of the body. Reformation may limit the useful life of the body for the intended purpose. Body 804 may be designed to operate for a time limit that corresponds to a reasonable time for escape from or arrest of the target human or animal (e.g., 60 seconds).

Spear 805 may be formed of a material the same (e.g., integral with) or different from body 804.

Spear 805 may be formed of a composite material (e.g., a resin based material with conductive filler). The spear may exhibit an activation voltage for forming a path for continued current flow and/or an activation voltage for stimulating tissue of the target. Activation for either purpose may be associated with an initial voltage (e.g., threshold, breakdown, set-up, reformation) below which current sufficient for the purpose is not conducted through the body and after which maintaining the initial voltage is not required. As examples, spear 805 may be formed and/or covered to operate with an initial voltage for activation of forming a path to target tissue in the range of about 100 volts to about 25,000 volts. Spear 805 may be formed and/or covered to operate with an initial voltage for activation of stimulating tissue in the range of about 100 volts to about 5,000 volts. Meeting or exceeding an activation voltage and/or conducting ionization and/or stimulation current may reform a material of the spear. Reformation may limit the useful life of the spear for the intended purpose. Spear 805 may be designed to operate for a time limit that corresponds to a reasonable time for escape from or arrest of the target human or animal (e.g., 60 seconds).

Regional spreading structure 852 may include a conductive material 854 with or without an enclosing material. The conductive material may be gelatinous or liquid.

For activation to ionize and/or to stimulate, the current path from filament 802 to body 804 to dispensed gel 854 (e.g., dispensed like 308) is preferred. If such activation is not practical (e.g., excessive distance 322, highly insulative clothing), then for activation to ionize and/or stimulate, the current path from filament 802 to body 804 to shaft 808 may support activation of target tissue.

In operation of electrode 800, activation of target tissue may proceed in one or more paths analogous to paths discussed above with reference to FIGS. 2 and 3. Because tip 810 is insulated and because additional ionization paths exist in series with tip 810 due to the particle to particle distances in the composite material of shaft 808, an activation voltage of the regional spreading structure 852 is less than an activation voltage of tip 810. In addition, shaft 808 promotes by lower activation voltages the activation of target tissue from shaft 808 near the skin of the target as opposed to tip 810.

EXAMPLES OF THE INVENTION

First, a deployment unit in operation provides a current from a signal generator (not part of the deployment unit) through tissue of a target. The current inhibits voluntary movement by the target. The deployment unit includes a housing, an interface, a filament, an electrode, a propellant, a binding deploying structure, and a coupling structure. The interface couples the housing to the signal generator so that the interface receives the current. The filament is stored in the housing until deployment of the filament. The filament is coupled to the interface for receiving the current. The filament conducts the current to the electrode. The electrode is stored in the housing until deployment of the electrode. The propellant, in the housing, in operation propels the electrode away from the housing to deploy the filament toward the target. The electrode includes a binding deploying structure and a coupling structure. The binding deploying structure is mechanically coupled to the filament to deploy the filament from the housing. The coupling structure includes a shaft and a tip. The coupling structure is mechanically coupled to the binding deploying structure. The shaft has a longitudinal axis. The tip is for piercing the target. The shaft includes a locale (e.g., surface. A portion of the shaft along the axis separates the locale from the tip. The locale couples the electrode to the target.

Second, a deployment unit in operation provides a current from a signal generator (not part of the deployment unit) through tissue of a target. The current inhibits voluntary movement by the target. The deployment unit includes a housing, an interface, a filament, an electrode, a propellant, a binding deploying structure, and a coupling structure. The interface couples the housing to the signal generator so that the interface receives the current. The filament is stored in the housing until deployment of the filament. The filament is coupled to the interface for receiving the current. The filament conducts the current to the electrode. The electrode is stored in the housing until deployment of the electrode. The propellant, in the housing, in operation propels the electrode away from the housing to deploy the filament toward the target. The electrode includes a binding deploying structure and a coupling diffusing structure. The binding deploying structure is mechanically coupled to the filament to deploy the filament from the housing. The coupling diffusing structure includes a shaft and a tip. The coupling diffusing structure is mechanically coupled to the binding deploying structure. The shaft has a longitudinal axis. The tip is for piercing the target. The shaft includes a surface. A portion of the shaft along the axis separates the surface from the tip. The surface electrically couples the current through the target.

Third, a deployment unit in operation provides a current from a signal generator (not part of the deployment unit) through tissue of a target. The current inhibits voluntary movement by the target. The deployment unit includes a housing, an interface, a filament, an electrode, a propellant, a binding deploying structure, and a coupling structure. The interface couples the housing to the signal generator so that the interface receives the current. The filament is stored in the housing until deployment of the filament. The filament is coupled to the interface for receiving the current. The filament conducts the current to the electrode. The electrode is stored in the housing until deployment of the electrode. The propellant, in the housing, in operation propels the electrode away from the housing to deploy the filament toward the target. The electrode includes a binding deploying structure and a coupling diffusing structure. The binding deploying structure is mechanically coupled to the filament to deploy the filament from the housing. The coupling diffusing structure includes a shaft and a tip. The coupling diffusing structure is mechanically coupled to the binding deploying structure. The shaft includes a plurality of conductors spaced apart from the tip that cooperate to form a series circuit for the current through the target.

Fourth, a deployment unit in operation provides a current from a signal generator (not part of the deployment unit) through tissue of a target. The current inhibits voluntary movement by the target. The deployment unit includes a housing, an interface, a filament, an electrode, a propellant, a binding deploying structure, and a coupling structure. The interface couples the housing to the signal generator so that the interface receives the current. The filament is stored in the housing until deployment of the filament. The filament is coupled to the interface for receiving the current. The filament conducts the current to the electrode. The electrode is stored in the housing until deployment of the electrode. The propellant, in the housing, in operation propels the electrode away from the housing to deploy the filament toward the target. The electrode includes a binding deploying structure, and a coupling diffusing structure. The binding deploying structure is mechanically coupled to the filament to deploy the filament from the housing. The coupling diffusing structure is mechanically coupled to the binding deploying structure. The coupling structure includes a tip. The coupling diffusing structure is capable of coupling the electrode to the target. Further, the coupling diffusing structure is capable of inhibiting a portion of the current from flowing into the target through the tip by enabling the portion of the current to flow out of the coupling diffusing structure and into the target at a first distance away from the tip.

Fifth, a deployment unit in operation provides a current from a signal generator (not part of the deployment unit) through tissue of a target. The current inhibits voluntary movement by the target. The deployment unit includes a housing, an interface, a filament, an electrode, and a propellant. The interface couples the housing to the signal generator so that the interface receives the current. The filament is stored in the housing until deployment of the filament. The filament is coupled to the interface for receiving the current. The filament conducts the current to the electrode. The electrode is stored in the housing until deployment of the electrode. The propellant, in the housing, in operation propels the electrode away from the housing to deploy the filament toward the target. The electrode includes a binding deploying structure, a coupling structure, and a regional spreading structure. The binding deploying structure is mechanically coupled to the filament to deploy the filament from the housing. The coupling structure is mechanically coupled to the binding deploying structure. The coupling structure couples the electrode to the target. The regional spreading structure enables a portion of the current to flow into the target at a first distance away from the coupling structure.

In one implementation, the regional spreading structure extends away from a longitudinal axis of the electrode to contact the target. The distance from the coupling structure to the place where current flows into the target is greater than a distance the electrode extends away from its longitudinal axis prior to impact with the target.

In another implementation, the regional spreading structure dispenses a conductive material to contact the target to a distance from an axis of the electrode greater than a radius of the electrode prior to impact of the electrode with the target.

Sixth, a deployment unit in operation provides a current from a signal generator (not part of the deployment unit) through tissue of a target. The current inhibits voluntary movement by the target. The deployment unit includes a housing, an interface, a filament, an electrode, a propellant, a binding deploying structure, and a coupling structure. The interface couples the housing to the signal generator so that the interface receives the current. The filament is stored in the housing until deployment of the filament. The filament is coupled to the interface for receiving the current. The filament conducts the current to the electrode. The electrode is stored in the housing until deployment of the electrode. The propellant, in the housing, in operation propels the electrode away from the housing to deploy the filament toward the target. The electrode includes a binding deploying structure, a coupling diffusing structure, and a regional spreading structure. The binding deploying structure is mechanically coupled to the filament to deploy the filament from the housing. The coupling diffusing structure is mechanically coupled to the binding deploying structure. The coupling diffusing structure couples the electrode to the target. The coupling diffusing structure spreads electric field flux density to tissue away from a tip of the coupling diffusing structure. The regional spreading structure spreads electric field flux density into a region of a surface of the target.

What is claimed is:

1. A deployment unit for use with an electronic weapon, the deployment unit providing a current from a signal generator of the electronic weapon through tissue of a human or animal target, the current for inhibiting voluntary movement by the target, the deployment unit comprising:

a housing;

an interface that couples the housing to the signal generator, the interface for receiving the current;

a filament that conducts the current, the filament stored in the housing prior to deployment, the filament coupled to the interface for receiving the current;

an electrode stored in the housing prior to deployment; and a propellant that in operation propels the electrode away from the housing to deploy the filament toward the target; wherein the electrode comprises a binding and deploying structure mechanically coupled to the filament to deploy the filament from the housing; and a coupling and diffusing structure comprising a shaft and a tip, the coupling and diffusing structure mechanically coupled to the binding and deploying structure, the coupling and diffusing structure capable of activating the tip for a first portion of the current at a first activation voltage and capable of activating at least a portion of the shaft for a second portion of the current at a second activation voltage less than the first activation voltage.

2. The deployment unit of claim 1 wherein the shaft comprises a plurality of conductors spaced apart from the tip that cooperate to form a series circuit for the current through the target.

3. The deployment unit of claim 2 wherein each conductor comprises a ring about an axis of the shaft.

4. The deployment unit of claim 2 wherein:

the shaft further comprises an insulative material; and each conductor comprises a particle integrated within the insulative material.

5. The deployment unit of claim 1 wherein the coupling and diffusing structure couples to the target as a consequence of the tip penetrating clothing or tissue of the target.

6. The deployment unit of claim 1 wherein the coupling and diffusing structure comprises composite material.

7. The deployment unit of claim 1 wherein the binding and deploying structure is formed with the coupling and diffusing structure.

8. The deployment unit of claim 1 wherein:

the shaft comprises a first volume and a second volume;

the first volume and the second volume are of equal measure;

the first volume is located closer to the tip than the second volume; and the first volume has a lower conductivity at an activation voltage than the second volume has at the activation voltage.

9. An electrode, for providing a current from an electronic weapon through tissue of a human or animal target, the current for inhibiting voluntary movement by the target, the electrode comprising:

a tip; and a shaft that supports the tip and penetrates tissue of the target; wherein the shaft inhibits conduction of the current through the tip; and the shaft diffuses a portion of the current into target tissue, thereby reducing a remainder of the current conducted through the tip.

10. The electrode of claim 9 wherein the tip comprises a barb that mechanically couples the electrode to tissue of the target.

11. The electrode of claim 9 wherein diffusing by the shaft decreases flow of current into target tissue through the tip.

12. The electrode of claim 9 wherein the shaft comprises a resistive material.

13. The electrode of claim 9 wherein the shaft comprises a composite material.

14. A method for conducting a current into tissue of a human or animal target, the method comprising:

propelling a wire-tethered electrode from an electronic weapon to penetrate tissue of the target, the electrode comprising a tip and a shaft that inhibits conduction of the current through the tip; and diffusing the current into target tissue along a length of the shaft wherein a. the current interferes with the target's voluntary use of its skeletal muscles; and b. the shaft penetrates the tissue along the length.

15. The method of claim 14 wherein interfering comprises causing involuntary contraction of skeletal muscles.

16. The method of claim 14 wherein interfering comprises causing pain to the target to motivate the target to voluntarily stop moving.

17. A deployment unit for use with an electronic weapon, the deployment unit providing a current from a signal generator of the electronic weapon through tissue of a human or animal target, the current for inhibiting voluntary movement by the target, the deployment unit comprising:

a housing;

an interface that couples the housing to the signal generator, the interface for receiving the current;

a filament that conducts the current, the filament stored in the housing prior to deployment, the filament coupled to the interface for receiving the current;

an electrode stored in the housing prior to deployment; and a propellant that in operation propels the electrode away from the housing to deploy the filament toward the target; wherein the electrode comprises a spear that, after the electrode is propelled away from the housing to deploy the filament toward the target, penetrates tissue of the target along a length of the spear;

the spear inhibits conduction of the current through a tip of the spear; and the spear diffuses a portion of the current along the length of the spear to reduce an electric field density that would otherwise occur at the tip.

* * * * *